US008878665B2

(12) United States Patent
Kalivas et al.

(10) Patent No.: US 8,878,665 B2
(45) Date of Patent: Nov. 4, 2014

(54) FIRE ALARM POWER LINE CARRIER COM-SYSTEM

(76) Inventors: Christopher George Kalivas, Patchogue, NY (US); Steven Perry Apelman, Centereach, NY (US)

( * ) Notice: Subject to any disclaimer, the term of this patent is extended or adjusted under 35 U.S.C. 154(b) by 350 days.

(21) Appl. No.: 13/320,497

(22) Filed: Nov. 14, 2011

(65) Prior Publication Data

US 2013/0049951 A1 Feb. 28, 2013

Related U.S. Application Data

(63) Continuation-in-part of application No. PCT/US2011/036233, filed on May 12, 2011.

(60) Provisional application No. 61/345,056, filed on May 14, 2010.

(51) Int. Cl.
*G08B 1/08* (2006.01)
*G08B 17/00* (2006.01)
*G08B 25/06* (2006.01)

(52) U.S. Cl.
CPC ..... *G08B 25/06* (2013.01); *G08B 17/00* (2013.01)
USPC ..... 340/538; 340/577; 340/632

(58) Field of Classification Search
CPC ..... G08B 17/00; G08B 17/06; G08B 17/10; G08B 25/00; G08B 25/01; G08B 25/06; G08B 1/08; H04B 3/54; H04B 3/56; H04B 2203/5429; H04B 2203/5458; H04B 2203/5462
USPC ..... 340/538, 533, 12.32, 13.23, 577, 632
See application file for complete search history.

(56) References Cited

U.S. PATENT DOCUMENTS

| | | | | |
|---|---|---|---|---|
| 2,567,908 | A * | 9/1951 | Levy | 340/288 |
| 4,956,875 | A * | 9/1990 | Bernard et al. | 455/13.1 |
| 5,168,262 | A * | 12/1992 | Okayama | 340/523 |
| 5,999,094 | A | 12/1999 | Nilssen | |
| 6,611,204 | B2 * | 8/2003 | Schmurr | 340/538 |
| 6,778,082 | B2 | 8/2004 | Goodwin | |
| 6,788,198 | B2 * | 9/2004 | Harshaw | 340/522 |
| 6,822,555 | B2 * | 11/2004 | Mansfield et al. | 340/538.11 |
| 7,301,455 | B2 | 11/2007 | McKenna et al. | |

(Continued)

OTHER PUBLICATIONS

International Search Report of PCT/US2011/036233 and Written Opinion of the International Searching Authority dated Feb. 9, 2012.

*Primary Examiner* — Steven Lim
*Assistant Examiner* — Ryan Sherwin
(74) *Attorney, Agent, or Firm* — Collard & Roe, P.C.; Christopher B. Garvey

(57) ABSTRACT

A fire alarm system 4 for a structure, has a two-wire interconnected transceiver 4J that uses power line carrier technology to inject a radio signal onto two power conductors, 6B & 6W. The transceiver 4J includes a transmitter circuit 7 and a receiver circuit 9. The transmitter circuit 7 includes a trigger circuit 10, attachable to an output line of a local fire alarm 5. The trigger circuit 10, can monitor the output line (6 Yellow) for an alarm condition output signal, for the purpose of sensing an alarm condition. The transmitter circuit 7 responds to the alarm condition output signal by injecting the radio signal onto the two power conductors. The radio signal would activate a second fire alarm system 4B attached to power lines in the structure.

1 Claim, 8 Drawing Sheets

(56) References Cited

U.S. PATENT DOCUMENTS 7,403,096 B2 * 7/2008 Curran et al. ..... 340/293
2004/0097137 A1 5/2004 Devine et al.
2005/0156669 A1 * 7/2005 Ando ..... 330/285

* cited by examiner

Microprocessor 10 Section
Transmitter Section 7
Reciever Section 9
10A
PIC16C54
LM78L05ACHA
455KHz RECIEVED ALARM
LOCAL ALARM DRIVE
120 VAC Power Line
AIR CORE 75T:150T
455 KHz
XMTR ON
Yellow A
+5V
GND

FIRE ALARM POWER LINE CARRIER COM-SYSTEM

PRIORITY

This application is a continuation in part of, and National Phase of, and takes priority from PCT Application: PCTUS2011/036233, filed May 12, 2011, pending, for any common subject matter, and is a continuation in part thereof for any new matter.

Said PCT application is a non-provisional of and takes priority from U.S. Provisional Application: 61/345,056, filed 14 May 2010, when the PCT Application was filed.

The present application also takes priority, for any common subject matter, from said U.S. Provisional Application: 61/345,056, filed 14 May 2010, through said PCT Application.

Those Applications are all hereby incorporated by reference.

FIELD

The present invention is a device, and a two-wire interconnection scheme, that serves as an adapter 4 to interconnect and activate numerous residential 120 VAC operated smoke alarms 5 without the addition of a third red electrical conductor wire 6 required to trigger the independent audio alert line at the local alarm drive A. The present invention includes methods of installing and operating such a device.

BACKGROUND OF THE INVENTION

Fire Codes for buildings in most States require that one and two story dwellings maintain and often upgrade the alarm systems by interconnecting their smoke alarms and CO detectors for simultaneous operation. After interconnection, when one alarm sensor detects a hazard at one end of the house, all other installed alarm sensors, even ones located at the other end of a house, as well as each bedroom, are energized simultaneously and begin to emit their alarm sound. (FIG. 3)

Alarm interconnection has been proven to give people more time to escape from a structural fire. That extra time results in the saving of lives and property in a far greater proportion than when interconnection is not used.

The conventional method of accomplishing the necessary interconnection is to install each device with a third electrical wire connection 6. Two wires, white 6W and black 6B, provide the commercial power, such as 120 VAC 60 Hz power in the United States, or other commercial power, such as 230 VAC 50 Hz found in other countries.

A third trigger wire, usually red, 6 Red, is normally strung between alarms and is employed for interconnecting the low voltage signal needed to activate the other alarms installed within the building. This is typically a standard 9 VDC. Most United States Building and Fire Codes require this form of alarm interconnection in all new construction. Property Maintenance Codes require existing homes to be upgraded in this manner when and where it is feasible. When a fire or CO alarm actuates, it shorts this 9 VDC to its yellow alarm wire, which is conductively connected to the structure's red alarm wire 6.

THE PRESENT INVENTION

This present invention makes it possible for all existing homes to receive the enhanced safety benefit of interconnecting all alarms in a house, while eliminating the expensive burden and inconvenience of rewiring, while still complying with state and local codes regarding alarm systems.

DETAILED DESCRIPTION

Figure 2:
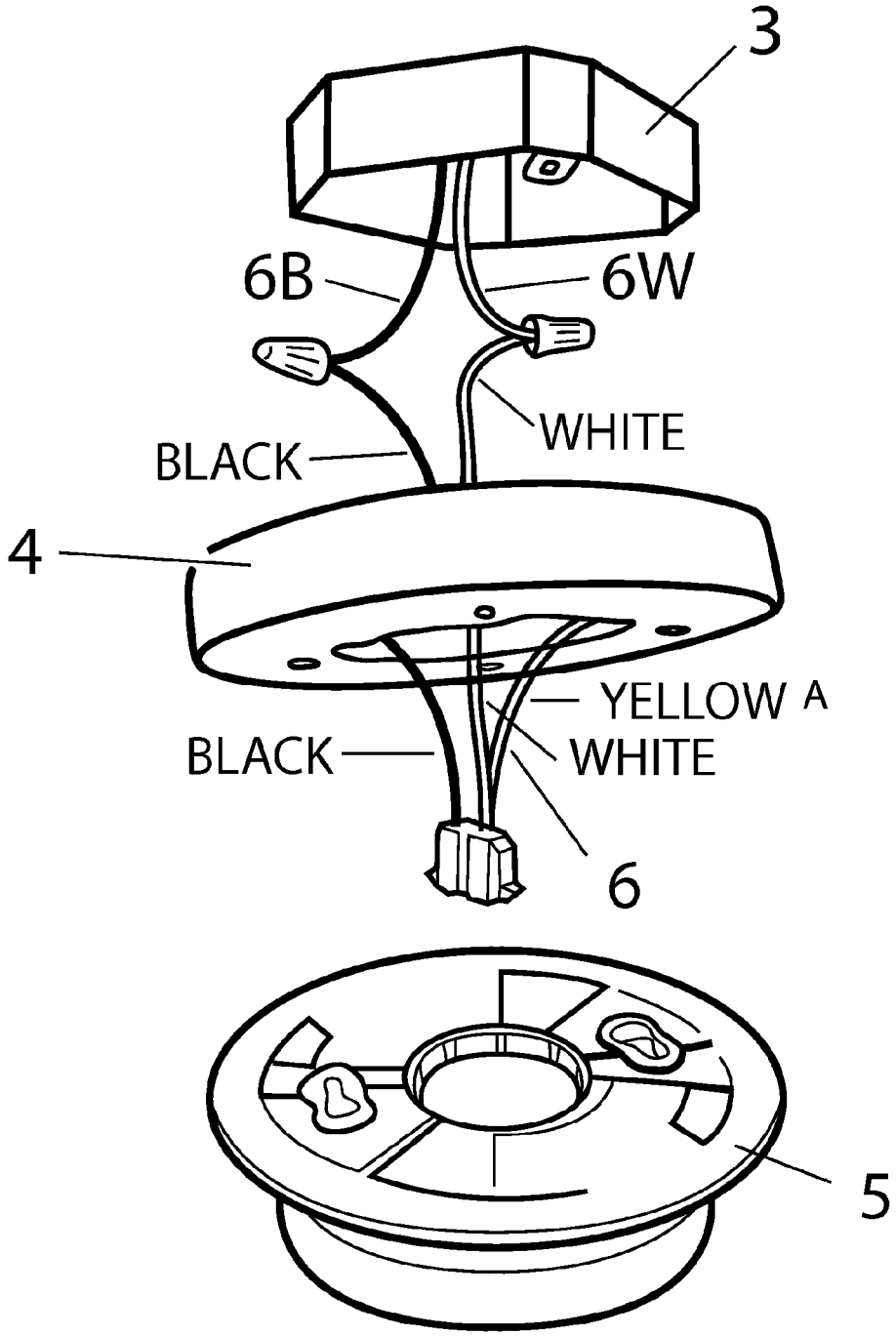
FIG. 2 is a perspective view of the present invention.

FIG. 2 shows that this present invention is a transceiver 4, which simply mounts between:

an electrical receptacle 3 that supplies the structure's 120 VAC commercial power, and a local smoke alarm or CO detector 5 as in FIG. 2.

The present invention 4 comprises a 2-wire interconnected transceiver circuit, generally designated 4J, (FIG. 1) that uses power line carrier technology to inject an RF signal onto the two conductors: Black 6B and White 6W (FIG. 2), that deliver the commercial power. The transceiver 4J (FIG. 1) comprises both a transmitter circuit 7 and a receiver circuit 9.

The transmitter portion 7 of the present invention is equipped with a trigger circuit 10 used to monitor the activity of output line YELLOW A, usually a yellow wire 6 YELLOW, of the local fire alarm sensor 5 it is attached to. When a low voltage (9 VDC) output signal is received on wire Yellow A (FIG. 1), from the red wire 6 (FIG. 2) of a local fire alarm 5, the Radio Frequency (RF) transmitter 7 is activated, resulting in a radio signal, preferably in this embodiment of 455 KHz, being injected via wires 6B & 6W onto the 2 wire 120 VAC power lines 6W & 6B within the building for the purpose of activating any other fire alarm system transceiver 4 (FIGS. 2 & 3) attached to the same 120 VAC power lines anywhere within the same structure, and thereby sounding the local fire alarm 5.

Should the 455 KHz receiver portion 9 of the present invention detect the presence of a 455 KHz. signal injected into the power lines 6W & 6B from any other fire alarm sensor 5 on the 120 VAC power line, it processes that signal through a state-of-the-art microprocessor 10A (FIG. 1) using specialized software for determining the validity of the alarm status. Such software can, for example, check the duration and or frequency of the alarm signal to make sure it's not a transient signal. When the validity of the alarm condition is confirmed, the microprocessor 10A (FIG. 1) activates the local fire alarm unit 5 (FIG. 2) attached to the present invention, and begins to emit the alarm sound.

This system allows as many alarms to be interconnected as desired. A smoke alarm and a carbon monoxide alarm could be in each room of as many rooms or zones as there are rooms or zones supplied by the commercial power circuit. If each alarm 5 were connected through a transceiver such as 4, all would be interconnected. All would alarm in response to an alarm from any one smoke or CO alarm.

A further feature of the present invention is to execute an "echo" transmission of the 455 KHz. signal, when a confirmed alert is detected from another alarm 5, so that it also acts as a 455 KHz. generator for the purpose of activating all other fire alarm units 5 attached to the building's 120 VAC power lines. This feature makes each transceiver 4 a repeater, and thereby increases the range of each alarm to every other alarm on the house circuit.

Figure 3:
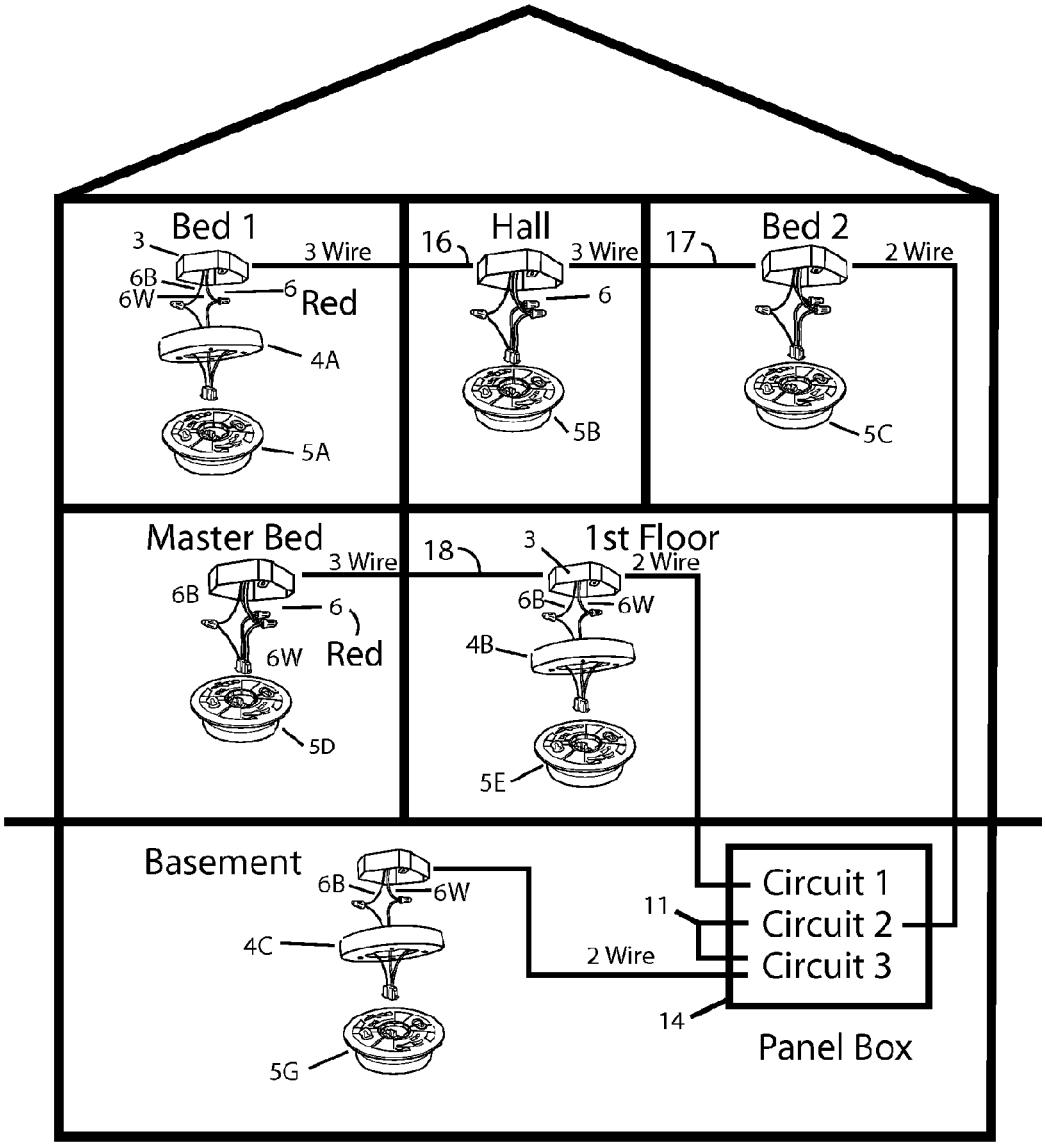
FIG. 3 is a block diagram showing use of three units of the invention in a dwelling.

As in FIG. 3, when there is a section of a house, such as:

Bed 1, Hall and Bed 2, that is already interconnected by a third conductor 6 Red, which is one of the three-wire conductors 16-17 therebetween, and additional smoke alarms such as 5D, 5E and 5G need to be interconnected to them, (FIG. 3) then, only one adapter, such as 4A, is needed to connect all the transceiver 4 equipped local alarms 5 such as 5A, 5E & 5G to the group (5G, 5B and 5C) that is pre-wired by three-wire conductors 16-17.

Similarly, transceiver 4B connects the three-wired conductor 18 group of:

1st Floor alarm 5D and Master Bed alarm 5E, to all the other in-house alarms 5A-5C & 5G.

Any further additional transceiver mounted alarms would also be thereby connected to the pre-existing interconnected alarm group through the group's transceiver 4B.

If:

two devices, such as 4A & 4B are used in a house; and they are not on the same phase, (e.g. Circuit 2 & Circuit 3) of the electrical supply;

then a bridge circuit 11 must be installed between the two phases (Circuit 2 & Circuit 3) in the panel box 14.

Or, the installer can change the position of that particular circuit onto the same phase as the others, as by moving the 2 Wire from Circuit 3 to Circuit 2. He can usually do so at the circuit breaker panel box 14.

Thus, as many alarms can be interconnected in a structure, as there are existing commercial power supply points, without hiring a licensed electrician to run a new three-wire alarm circuit for each new local alarm 5.

Figure 1:
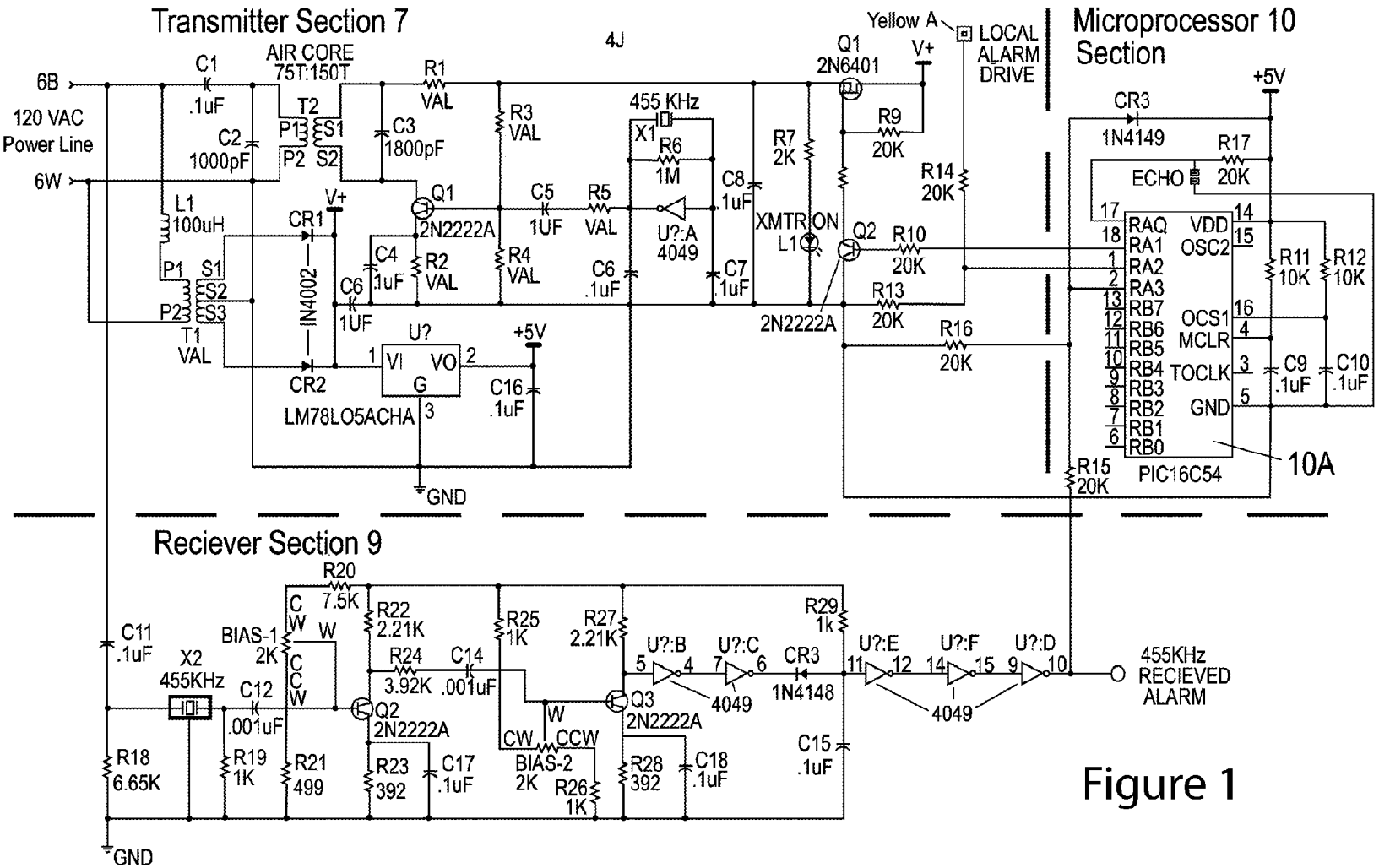
FIG. 1 is a circuit diagram of the present invention.
Figure 4:
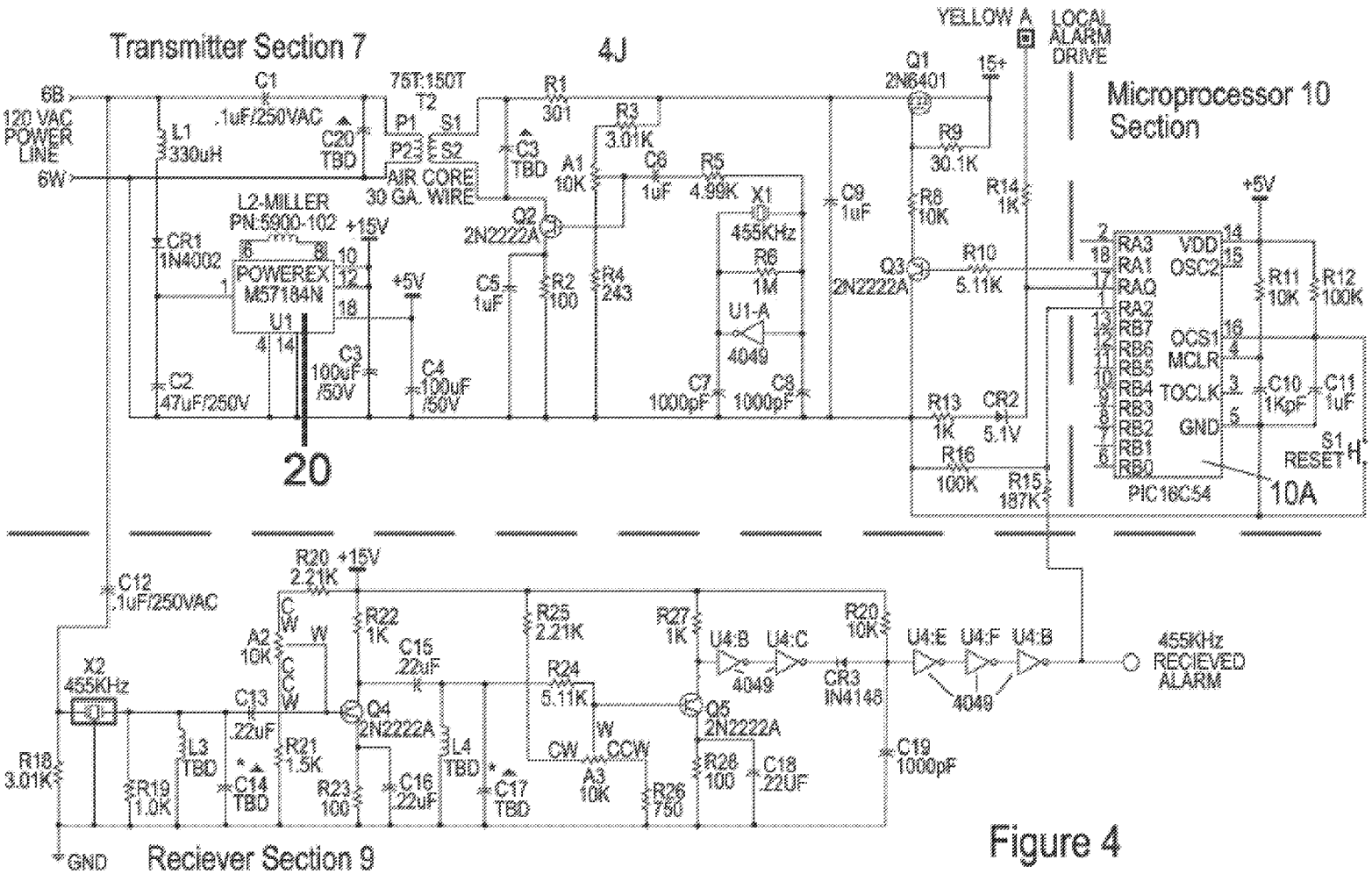
FIG. 4 is a circuit diagram of the present invention, similar to FIG. 1, with a modified power supply.

FIG. 4 is a circuit diagram, similar to FIG. 1. FIG. 4 shows another embodiment with a slightly different power supply 20, which is preferably a Powerex M57184N, in transmitter section 7.

Figure 6:
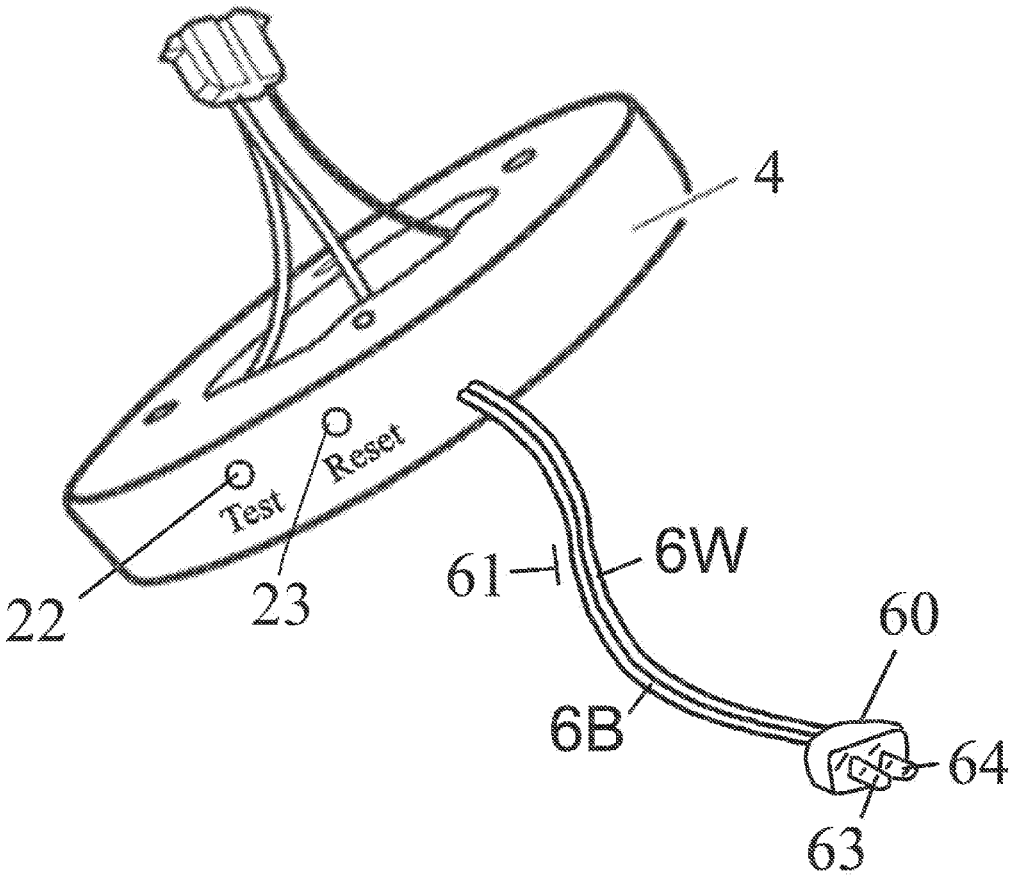
FIG. 6 is a perspective view of an alternate embodiment.

To further simplify installation, transceiver 4 can be equipped with an AC plug 60 FIG. 6, to plug directly into AC receptacles, where fire codes don't forbid such installations. This plug obviates the need to open boxes and twist wires. A disadvantage of a plug 60 is that, it may be easily unplugged, which would disable the alarm.

Figure 5:
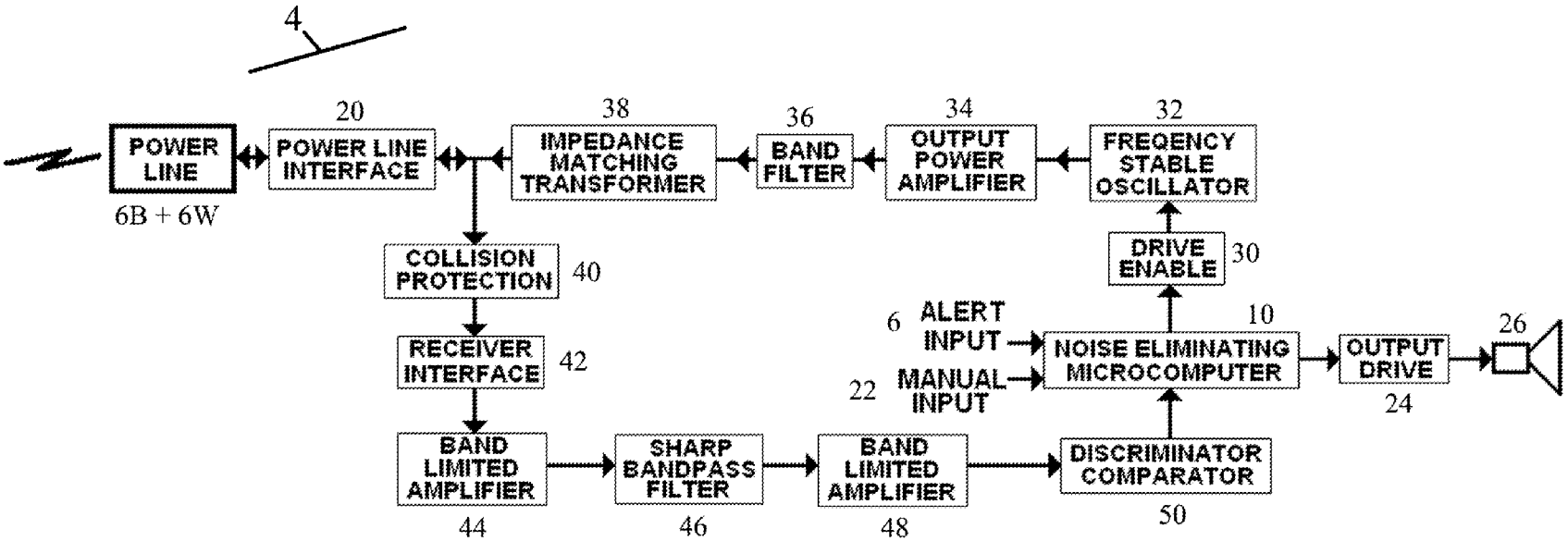
FIG. 5 is a block diagram of the elements of the transceiver 4.

FIG. 5 is a block diagram of the elements of the transceiver 4. Power is supplied through 110 Volt power wires 6B and 6W.

This power goes through a power line interface 20, which provides low voltage DC power to the transceiver 4.

When a 9 VDC alert input comes from detection of the smoke or CO alarm through wire 6; or when a manual input occurs through pressing:

the test button on the alarm 5, or an optional test button 22 (FIGS. 2, 6, 7, 8) on transceiver 4, then (FIG. 5) the signal is filtered through a noise eliminating micro computer 10.

If a test button 22 is provided, there should also be a reset button 23 (FIGS. 2, 6, 7, 8).

If, as in FIG. 5, the signal passes a screening test by the noise eliminating micro computer 10, then a 9 VDC alarm signal is sent through output drive 24, which actuates audible warning device 26.

Additionally drive enable 30 is stimulated to actuate frequency stable oscillator 32, which outputs a radio wave, preferably in this embodiment 455 kHz, to output power amplifier 34, which amplifies that wave. We may find as the population of these alarms becomes dense, that it is helpful to provide an adjustable frequency or provide adjustably coded signals, to discriminate between interfering alarm signals. An adjustment control for adjustable frequency or adjustably coded signals is contemplated within the scope of this invention.

The radio frequency (RF) wave then passes through filter 36, through impedance matching transformer 38, and is injected through the powerline interface 20, into power lines 6B and 6W, for receipt by the other transceivers to actuate their alarms 26.

When another alarm such as 5A (FIG. 3) actuates its alarm, its transceiver 4 injects a similar radio frequency signal through its powerline interface 20, and through its powerlines 6B and 6W, into the electrical power circuit of the structure.

In FIG. 5, the power and RF enter circuit 4 through wires 6B and 6W (FIG. 5). The signal goes through power line interface 20.

The signal is filtered through collision protection 40, and if it passes that screening, to receiver interface 42.

A band limited amplifier 44 amplifies only a specific frequency used as the alarm frequency, preferably, in the presently preferred embodiment a frequency of about 455 kHz. Sharp band pass filter 46 further screens and narrows the frequency. This narrowed wave is then input into band limited amplifier 48 which amplifies it. The amplified wave is input to a discriminator comparator 50 which ascertains that the input signal is indeed 455 kHz, or whatever is the preferred frequency of this particular model.

The signal is passed from discriminator comparator 50 to noise eliminating microcomputer 10, and if it is determined not to be noise, a signal is sent to output drive 24 which actuates sound warning 26.

As part of the repeater feature the noise eliminating microcomputer 10 also passes the signal to drive enable 30, which actuates frequency stable oscillator 32 to output the 455 kHz signal, which is amplified by power amplifier 34. The amplified wave then passes through band filter 36 to further narrow it. The narrowed wave then passes through impedance matching transformer 38, and then to powerline interface 20, where the amplified signal is again injected into power lines 6B and 6W, for further transmission down the power line, to other alarms 4, which might otherwise be out of range of the unit which transmitted the original alarm signal to the unit 4 depicted in FIG. 5.

FIG. 6 shows an alternate embodiment of transceiver 4 comprising a two prong plug 60 at the end of power cord 61. Cord 61 comprises power wires 6B and 6W. A conventional two prong power plug 60 has a live prong 63 and a neutral prong 64. Plug 60 may be plugged into any standard 120 VAC electrical outlet. This makes it easy for the electrically inept to install transceivers 4, where they are not required by code to be permanently wired.

An optioal test button 22 may be provided for an additional diagnostic tool, although the test button on the fire or CO alarm 5 can also test this part of the circuit. The advantage of the test button on unit 4 is that it allows the interface 4 to be tested independently of the detector 5.

A reset button 23 is a good way to terminate such a test, although the unit can alternately be designed to use a second press of Test 22 to terminate such a test.

Figure 7:
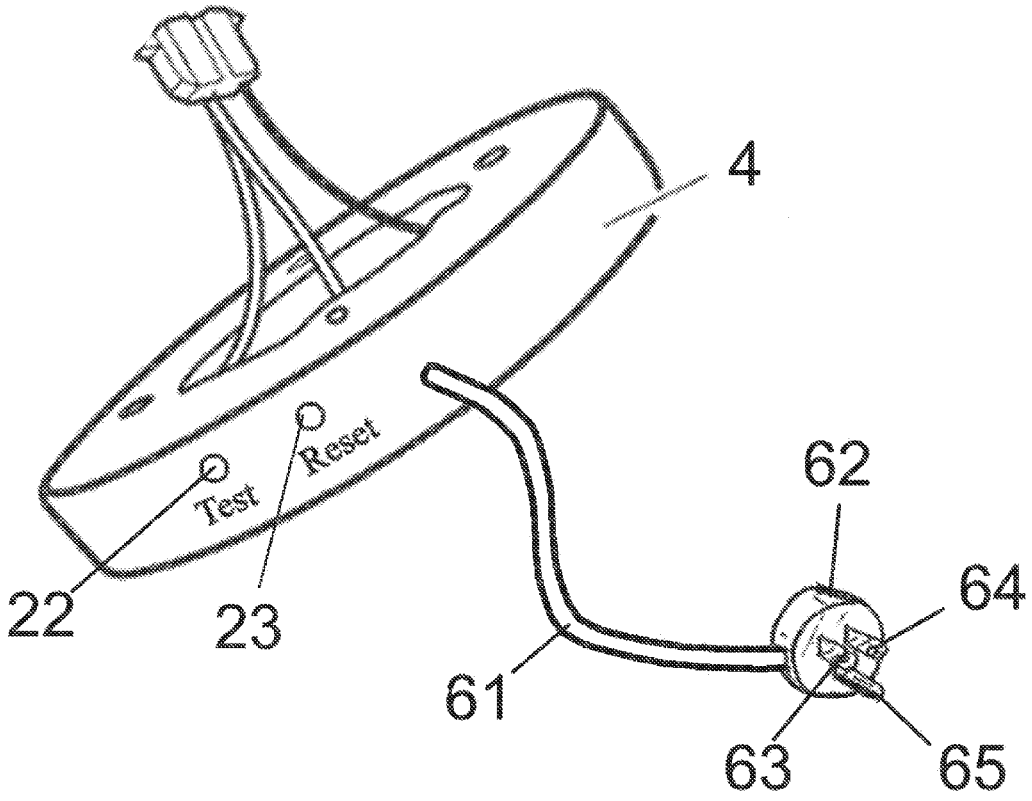
FIG. 7 is a perspective view of another alternate embodiment.

In FIG. 7, a three-prong power plug 62 is provided on three-conductor cord 61. A ground wire, in cord 61, connects ground prong 65 of plug 62.

Three prongs should not be necessary, since most fire alarms have two prong plugs. But in case some building code somewhere requires a ground prong 65, this configuration is envisioned as an alternative to an embodiment that has only two prongs 63 and 64.

Figure 8:
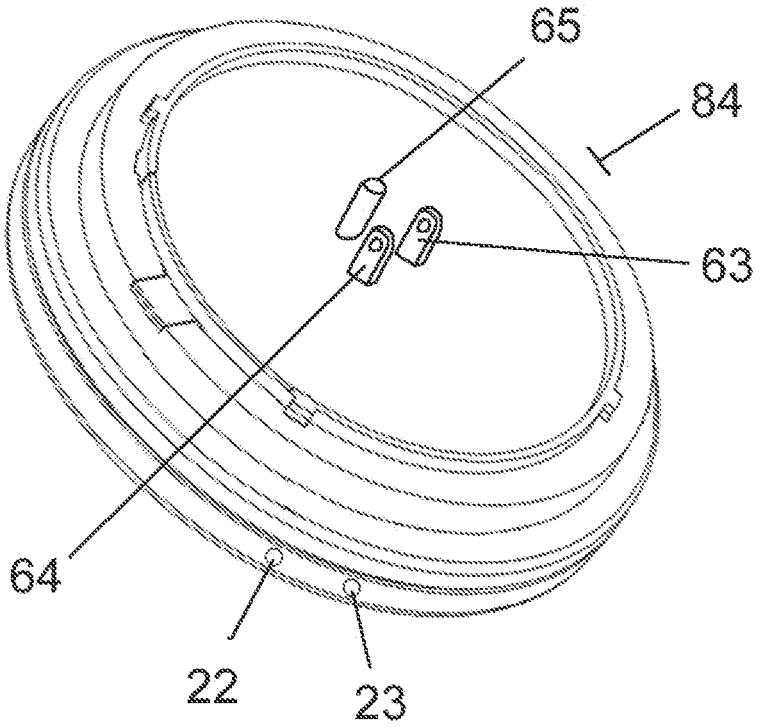
FIG. 8 is a perspective view of another alternate embodiment.

FIG. 8 shows a unit 84 in which the smoke detector or CO detector, or both, are integrated into the unit 84. Additionally an alternative power plug is shown having three prongs 63, 64 & 65 integrated onto the surface of the unit 84. This unit 84 can be mounted on a surface by plugging it 84 directly into a power receptacle in that surface. The friction of the prongs 63, 64 & 65 mounts unit 84 to the surface.

Alternatively, the integrated unit 84 may be equipped with a cord 60 and a plug 60 or 62, as shown in FIG. 6 or 7.

A "Test" switch 22 is essential in this unit 84, because there is no separate alarm unit 5, providing its switches for testing. A reset switch 23 is nice to have too.

We claim:

1. A method of interconnecting alarms in a structure, without installing a third conductor, said method comprising the steps of:

installing a transceiver between an alarm and said alarm's commercial power source, by:

disconnecting the alarm from two power conductors that supply the alarm's power;

connecting the transceiver to the two power conductors;

connecting the alarm to two power input conductors of the alarm; and connecting the alarm's alarm output conductor to the an alarm input of the transceiver;

similarly installing a second transceiver between a second alarm and said alarm's commercial power source;

power and the radio signal, as an RF alarm signal, enter circuit (4) through wires (6B and 6W);

the RF alarm signal goes through a power line interface (20);

the RF alarm signal is filtered through a collision protection (40*v*);

if said RF alarm signal passes the collision protection, said RF alarm signal is transmitted to receiver interface (42);

a band limited amplifier (44) amplifies only a specific frequency used as an alarm frequency of the RF alarm signal;

a sharp band pass filter (46) further screens and narrows the frequency;

said RF alarm signal is then input into band limited amplifier (48) which amplifies said RF alarm signal;

the amplified said RF alarm signal is input to a discriminator comparator (50), which ascertains that the input RF alarm signal is indeed the specific frequency used as the alarm frequency;

the RF alarm signal is passed from discriminator comparator 150 to noise eliminating microcomputer (10), and if it is determined not to be noise, the RF alarm signal is sent to output drive (24) which actuates sound warning (26);

the noise eliminating microcomputer (10) also passes the RF alarm signal to drive enable (30), which actuates frequency stable oscillator (32) to output the RF alarm signal;

the RF alarm signal is amplified by power amplifier (34);

the amplified RF alarm signal then passes through band filter (36) to further narrow RF alarm signal;

the narrowed RF alarm signal then passes through impedance matching transformer (38);

the narrowed RF alarm signal then passes to powerline interface (20); where the RF alarm signal is again injected into power lines (6B and 6W);

the RF alarm signal then is transmitted down the power line, to other alarm transceivers, which might otherwise be out of range of an alarm transceiver which transmitted the original RF alarm signal to the circuit (4).

* * * * *